US005605013A

United States Patent [19]

Hogston

[11] Patent Number: 5,605,013

[45] Date of Patent: Feb. 25, 1997

[54] PROGRAMMABLE AUTOMATIC WINDOW

[76] Inventor: Timothy W. Hogston, 2 Lake Ridge Pl., Apt L, Cockeysville, Md. 21030

[21] Appl. No.: 373,966

[22] Filed: Jan. 17, 1995

[51] Int. Cl.[6] ..... E05F 15/20

[52] U.S. Cl. ..... 49/31; 49/362

[58] Field of Search ..... 49/360, 362, 139, 49/140, 31

[56] References Cited

U.S. PATENT DOCUMENTS

| | | | |
|---|---|---|---|
| 2,625,218 | 1/1953 | Nihon | 49/139 X |
| 2,684,239 | 7/1954 | Gaffney | 49/140 X |
| 3,324,594 | 6/1967 | Hettinger et al. | 49/362 X |
| 3,330,071 | 7/1967 | Kubisiak | 49/362 |
| 4,348,835 | 9/1982 | Jones et al. | 49/139 |
| 5,006,766 | 4/1991 | Yuhas et al. | 49/139 X |
| 5,371,447 | 12/1994 | Boss | 49/29 |
| 5,422,552 | 6/1995 | Parisi | 49/140 X |

*Primary Examiner*—Kenneth J. Dorner
*Assistant Examiner*—Jerry Redman

[57] ABSTRACT

A programmable automatic window including a hollow frame with an aperture disposed therethrough; a window slidably secured within the aperture of the frame; a ball screw mechanism disposed within the frame and coupled to the window; a motor coupled to the ball screw mechanism and energizable with a positive polarity to cause rotation of the ball screw mechanism for allowing the window to be raised and energizable with a negative polarity to cause opposite rotation of the ball screw mechanism for allowing the window to be lowered; and motor logic switch circuitry for controlling the motor.

2 Claims, 5 Drawing Sheets

PROGRAMMABLE AUTOMATIC WINDOW

BACKGROUND OF THE INVENTION

1. Field of the Invention

The present invention relates to a programmable automatic window and more particularly pertains to allowing automatic opening and closing of a window based on environmental, timing, and user instructions with a programmable automatic window.

2. Description of the Prior Art

The use of window opening and closing apparatuses is known in the prior art. More specifically, window opening and closing apparatuses heretofore devised and utilized for the purpose of allowing automatic opening and closing of a window are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,003,102 to Hawks et al. discloses a door and window closer. U.S. Pat. No. 4,150,606 to Nelson discloses an automatic laboratory fume hood sash operator. U.S. Pat. No. 5,087,886 to Mann discloses a rain-activated sprinkler shut-off system. U.S. Pat. No. 5,115,601 to Yamaguchi et al. discloses a movable skylight. U.S. Pat. No. 5,123,875 to Eubank et al. discloses a power actuated roof vent apparatus and a method of use. U.S. Pat. No. 5,159,247 to Resch discloses a rain-actuated control for covering systems.

While these devices fulfill their respective, particular objective and requirements, the aforementioned patents do not describe a programmable automatic window that allows a window to be raised or lowered base on environmental, timing, or user indications and instructions.

In this respect, the programmable automatic window according to the present invention substantially departs from the conventional concepts and designs of the prior art, and in doing so provides an apparatus primarily developed for the purpose of allowing automatic opening and closing of a window based on environmental, timing, and user instructions.

Therefore, it can be appreciated that there exists a continuing need for new and improved programmable automatic window which can be used for allowing automatic opening and closing of a window based on environmental, timing, and user instructions. In this regard, the present invention substantially fulfills this need.

SUMMARY OF THE INVENTION

In the view of the foregoing disadvantages inherent in the known types of window opening and closing apparatuses now present in the prior art, the present invention provides an improved programmable automatic window. As such, the general purpose of the present invention, which will be described subsequently in greater detail, is to provide a new and improved programmable automatic window and method which has all the advantages of the prior art and none of the disadvantages.

To attain this, the present invention essentially comprises, in combination, a hollow rigid rectangular frame with a central rectangular aperture disposed therethrough. A generally rectangular window is included and has an upper part formed of a transparent sheet of material bounded by a rigid border secured within an upper extent of the aperture of the frame and a lower part formed of a transparent sheet of material bounded by a sash slidably secured within a lower extent of the aperture and positionable in a facing relationship with the upper part. A pair of elongated rigid threaded ball screws are included and disposed within the frame on either side of the window and with each ball screw having a base end rotatably coupled to the frame at a lower extent thereof and an upper end with an angled gear formed thereon extended a distance above the window. A pair of opposed and threaded ball screw nuts are included with each ball screw nut threadedly disposed on one of the ball screws and with each ball screw nut fixedly coupled to the sash of the window. A motor is included and disposed within and coupled to the frame at a location above the window. The motor has a central fixed stator and an elongated rotatable rotor extended therethrough and with each end of the rotor having an angle gear coupled thereto in mesh with one of the angle gears of a ball screw. The motor is electrically energizable with a positive polarity to cause rotation of the ball screws and upper displacement of the ball screw nut engaged therewith, thus allowing the lower part of the window to be raised for creating an opening for providing ventilation. The motor is further electrically energizable with a negative polarity to cause opposite rotation of the ball screws and downward displacement of the ball screw nut threadedly engaged therewith, thus allowing the lower part of the window to be lowered for closing the opening and preventing ventilation. A hand crank mechanism is coupled to the rotor of the motor and extended through the frame and actuatable by a hand-held wrench for manually rotating the rotor for generating movement of the lower part of the window. A power supply is included and coupleable with an external power source for providing electrical energy for operation. A temperature sensor is included and coupled to the frame and power supply for transmitting temperature indication signals. A rain sensor is included and coupled to the frame and power supply for transmitting rain indication signals. A real time clock is included and coupled to the power supply for transmitting real time clock signals. A keyboard is included and coupled to the power supply for generating a plurality of instruction signals upon actuation by a user. Microprocessor-based controller circuitry is included and coupled to the power supply, the temperature sensor, the rain sensor, the real time clock, and the keyboard for selectively generating a first motor activation signal and a second motor activation signal based upon receipt and evaluation of temperature indication signals, rain indication signals, real time clock signals, and instruction signals. A display mechanism is coupled to the controller circuitry for providing a visual indication of operation. Lastly, motor logic switch circuitry is included and coupled to the power supply for controlling operation of the motor. The motor logic switch circuitry includes a down magnetic switch coupled to the frame at a lower extent thereof and engagable with one of the downwardly moving ball screw nuts to thereby transmit a motor de-activation signal. The motor logic switch circuitry includes an up magnetic switch coupled to the frame at a central extent thereof and engagable with one of the upwardly moving ball screw nuts to thereby transmit a motor de-activation signal. The motor logic switch circuitry includes a momentary manually-depressible down switch having one orientation for transmitting a first motor activation signal. The motor logic switch circuitry includes a momentary manually-depressible up switch having one orientation for transmitting a second motor activation signal. The motor logic switch circuitry includes combinatorial switch circuitry coupled to the switches and controller circuitry for receiving the motor de-activation signals, first motor activation signals, and second motor activation signals from both the switches and controller circuitry during operation and then selectively transmitting the motor de-activation signal, the first motor activation signal, and the second motor activation signal. Lastly, the motor logic switch circuitry includes motor driving circuitry coupled to the combinatorial switch circuitry and the motor for allowing the motor to be energized with a positive polarity upon receipt of the first motor activation signal and for allowing the motor to be energized with a negative polarity upon receipt of the second motor activation signal. Furthermore, the motor logic switch circuitry prevents the motor from being energized upon receipt of the motor de-activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved programmable automatic window which has all the advantages of the prior art window opening and closing apparatuses and none of the disadvantages.

It is another object of the present invention to provide a new and improved programmable automatic window which may be easily and efficiently manufactured and marketed.

It is a further object of the present invention to provide a new and improved programmable automatic window which is of durable and reliable construction.

An even further object of the present invention is to provide a new and improved programmable automatic window which is susceptible of a low cost of manufacture with regard to both materials and labor, and which accordingly is then susceptible of low prices of sale to the consuming public, thereby making such a programmable automatic window economically available to the buying public.

Still yet another object of the present invention is to provide a new and improved programmable automatic window which provides in the apparatuses and methods of the prior art some of the advantages thereof, while simultaneously overcoming some of the disadvantages normally associated therewith.

Even still another object of the present invention is to provide a new and improved programmable automatic window for allowing automatic opening and closing of a window based on environmental, timing, and user instructions.

Lastly, it is an object of the present invention to provide a new and improved programmable automatic window comprising a hollow frame with an aperture disposed therethrough; a window formed of a transparent sheet of material bounded by a sash slidably secured within the aperture of the frame; a rotatable ball screw mechanism disposed within the frame and coupled to the window; a motor coupled to the ball screw mechanism and electrically energizable with a positive polarity to cause rotation of the ball screw mechanism for allowing the window to be raised and electrically energizable with a negative polarity to cause opposite rotation of the ball screw mechanism for allowing the window to be lowered; and motor logic switch circuitry coupled to the motor and engagable with the ball screw mechanism for controlling operation of the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
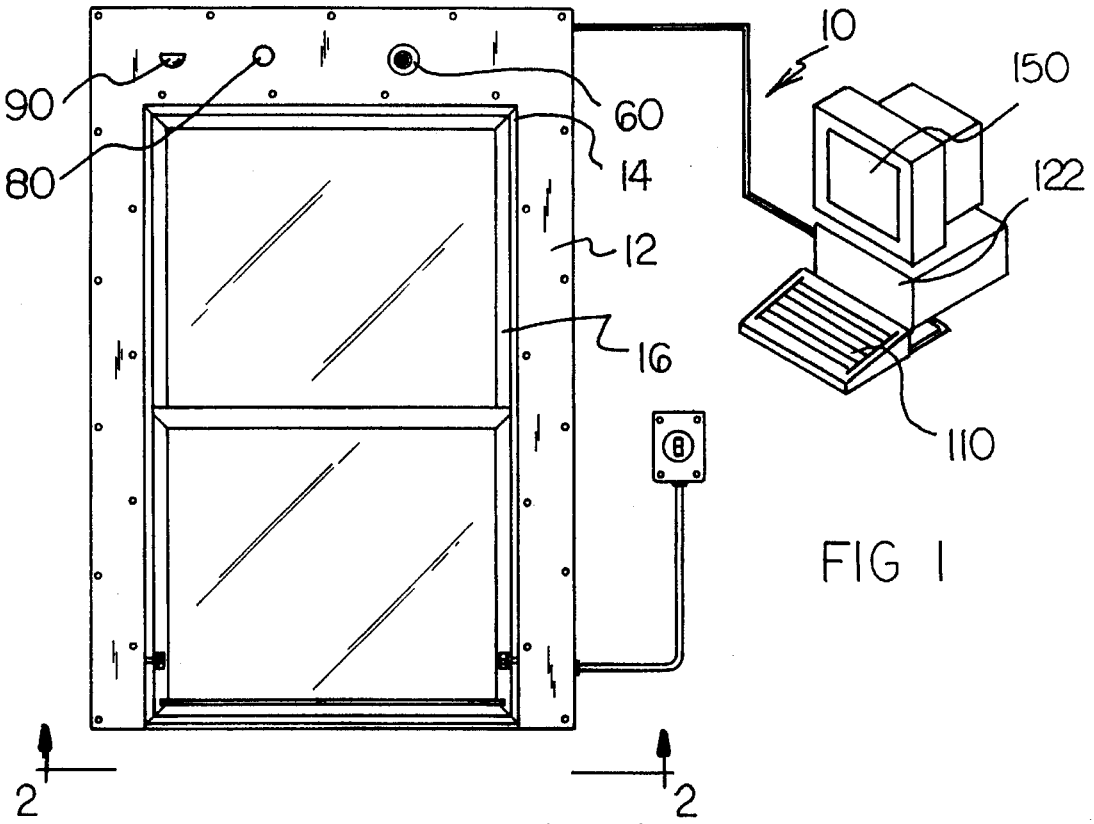
FIG. 1 is a view of the preferred embodiment constructed in accordance with the principles of the present invention.

With reference now to the drawings, and in particular, to FIG. 1 thereof, the preferred embodiment of the new and improved programmable automatic window embodying the principles and concepts of the present invention and generally designated by the reference number 10 will be described.

The present invention is comprised of a plurality of components. In their broadest context, such components include a framed openable window, ball screw mechanisms, a motor, and electric circuitry. Such components are individually configured and correlated with respect to each other to provide the intended function of opening and closing a window based on environmental, timing, and user instructions.

Figure 2:
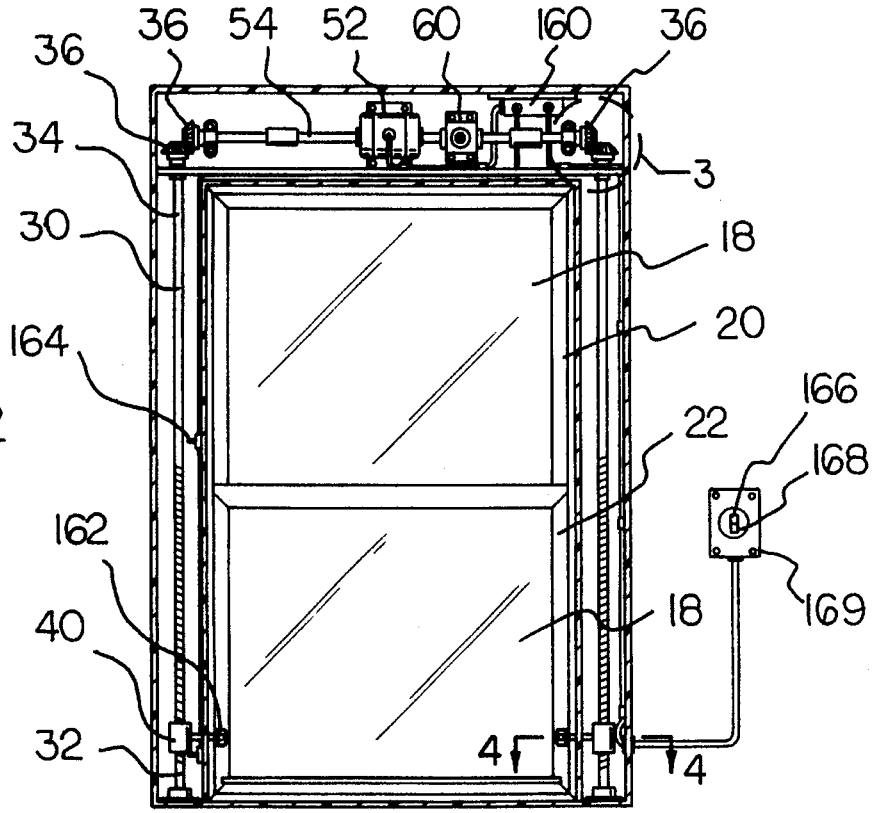
FIG. 2 is a cross-sectional view of the present invention taken along the line 2—2 of FIG. 1.
Figure 3:
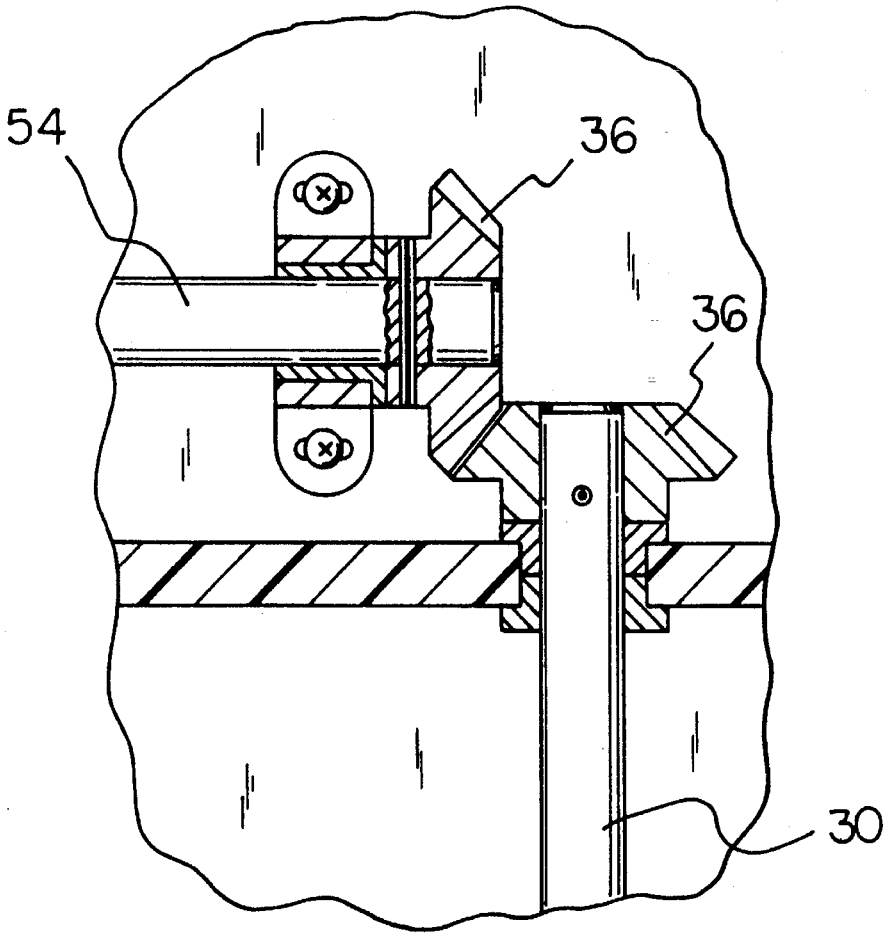
FIG. 3 is an enlarged view of the coupling of the shaft of the motor and ball screws of the present invention as shown in FIG. 2.

Specifically, the present invention includes a frame 12 as shown in FIGS. 1 and 2. The frame is hollow and rectangular in structure. It is formed of a rigid material such as metal, plastic or wood. The frame has a central rectangular aperture 14 disposed therethrough. The frame serves as a support for holding the remaining components of the present invention used to actuate its window.

Disposed within the aperture is a window 16. The window includes an upper part formed of a transparent sheet of material 18 such as plastic or glass. This sheet is bounded by a rigid border 20 secured within the upper extent of the aperture of the frame. The window also includes a lower part formed of a transparent sheet of material such as plastic or glass. This sheet is bounded by a sash 22. The sash is slidably secured within a lower extent of the aperture. The sash is positionable in a facing relationship with the upper part of the window when pulled upward.

To actuate the window, a pair of elongated ball screws 30 are provided as best illustrated in FIG. 2. The ball screws are rigid, elongated, and threaded in structure. The ball screws are disposed within the frame on either side of the window. Each ball screw has a base end 32 rotatably coupled to the frame at a lower extent thereof. Each ball screw also has an upper end 34 with an angle gear 36 formed thereon. The upper end is extended a distance above the window.

Figure 4:
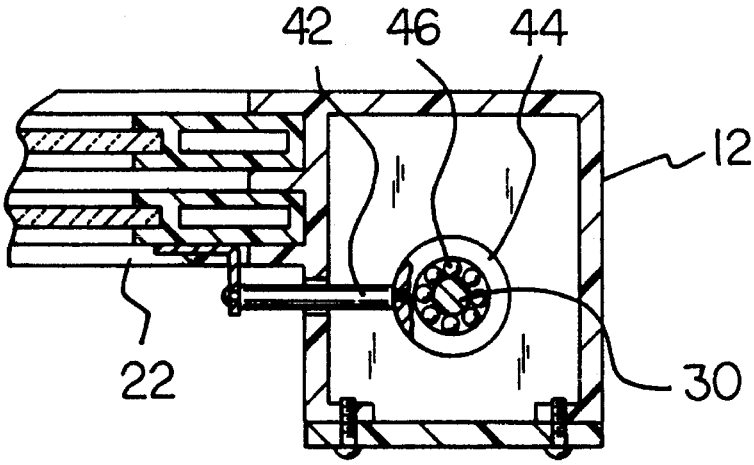
FIG. 4 is a cross-sectional view of the ball screw nut and its coupling with a ball screw taken along the line 4—4 of FIG. 2.

A pair of opposed and threaded ball screw nuts 40 are provided. Each ball screw nut is threadedly disposed on one of the ball screws 30 and moveable therealong. Each ball screw is further fixedly coupled to the sash 22 of the window. This coupling is performed with a pin 42 as shown in FIG. 4. Each ball screw nut includes a central tube 44 disposed around a ball screw 30 with a plurality of ball bearings 46 held therebetween. This structure allows the ball screw nut to readily traverse upwards or downwards along the ball screw when the ball screw is rotated.

A electric motor 50 is disposed within and coupled to the frame 12 at a location above the window 16. The motor has a central fixed stator 52 and an elongated rotatable rotor 54 extended therethrough. Each end of the rotor has an angle gear 36 coupled thereto. Each angle gear of the motor is separately positioned in mesh with one of the angle gears of a ball screw. The motor is electrically energizable with a positive polarity to cause rotation of the ball screws and upper displacement of the ball screw nut 40 engaged therewith, thus allowing the lower part of the window to be raised for creating an opening for providing ventilation. The motor is also electrically engaged with a negative polarity to cause opposite rotation of the ball screws and downward displacement of the ball screw nut threadedly engaged therewith, thus allowing the lower part of the window to be lowered for closing the opening and preventing ventilation.

A hand crank mechanism 60 is also provided in case of failure of the motor. The hand crank mechanism is coupled to the rotor 54 of the motor and extended through the frame 12. The hand crank mechanism is actuatable by a conventional hand-held wrench. The hand-held wrench is inserted within the hand crank mechanism and rotated for manually rotating the rotor for generating movement of the lower part of the window upwards or downwards.

Also included is a power supply 70. The power supply generates 5 volts DC for use. The power supply is coupleable with an external energy source such as a conventional household electrical receptacle through a plug 72. The power supply provides electrical energy to the electronic components of the present invention for operation. The power supply is conventional in design and commercially available.

Figure 6:
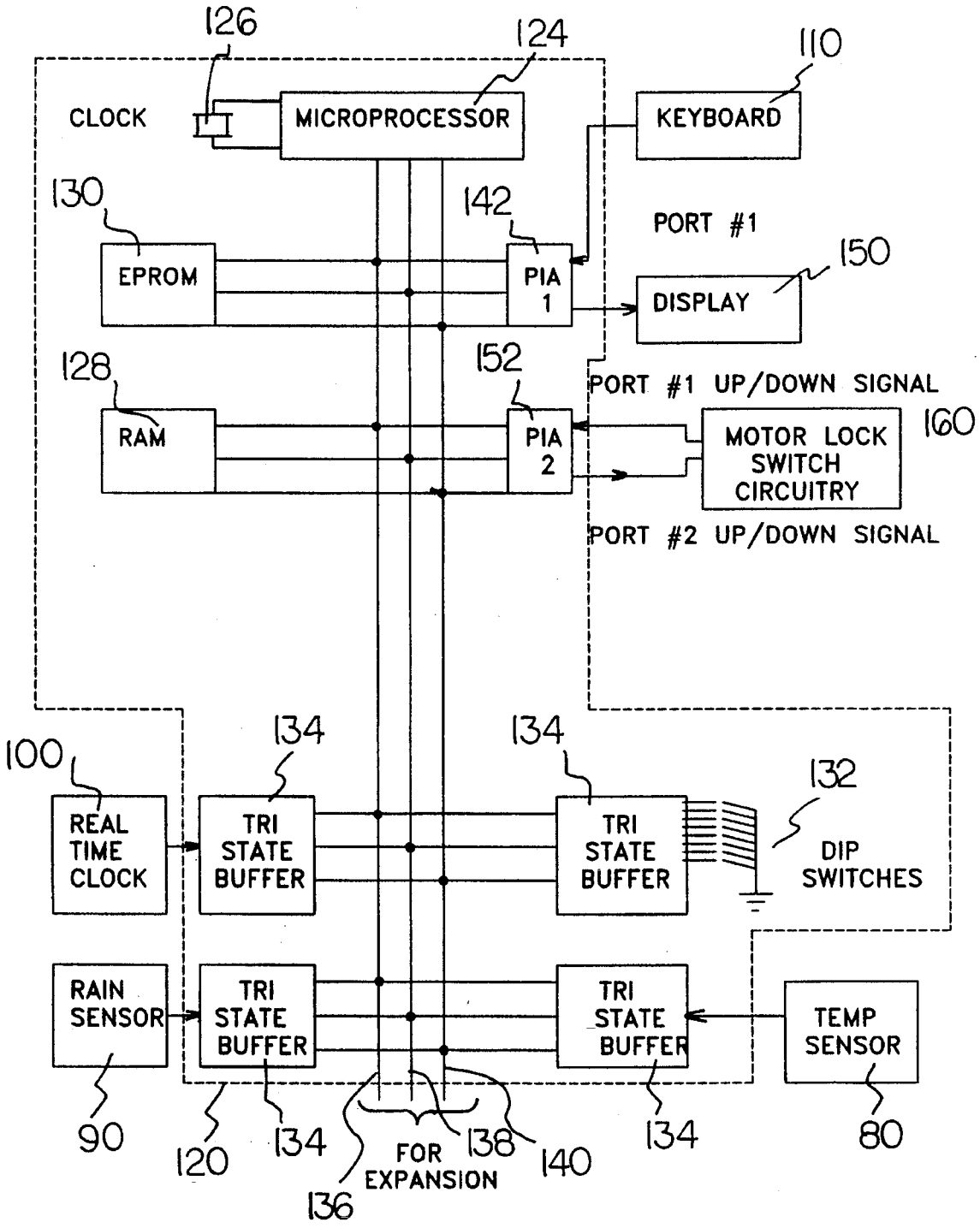
FIG. 6 is a schematic diagram of the microprocessor-based controller circuitry and its coupling with various ancillary indicator circuits.

A temperature sensor 80 is also provided as shown in FIG. 6. The temperature sensor is coupled to the frame 12 and power supply 70. The temperature sensor is used for transmitting temperature indication signals based on the temperature near the window. The temperature sensor is conventional in design and commercially available. The temperature sensor is extended from the frame as shown in FIG. 1.

Also provided as shown in FIG. 6 is a rain sensor 90. The rain sensor is coupled to the frame 12 and power supply 70. The rain sensor is used for transmitting rain indication signals for detecting the presence of precipitation is occurring outside the window. The rain sensor is conventional in design and commercially available. The rain sensor is extended from the frame as shown in FIG. 1.

A real time clock 100 as shown in FIG. 6 is used for keeping track of the current time and date. The real time clock is coupled to the power supply 70 and disposed within the frame. The real time clock is used for transmitting real time clock signals indicating a current time and date. The real time clock is formed of conventional electronic circuitry and is commercially available.

Also provided is a keyboard 110 as shown in FIG. 6. The keyboard is coupled to the power supply 70. The keyboard generates a plurality of instruction signals upon actuation by a user. The keyboard is conventional in design and commercially available.

Figure 7:
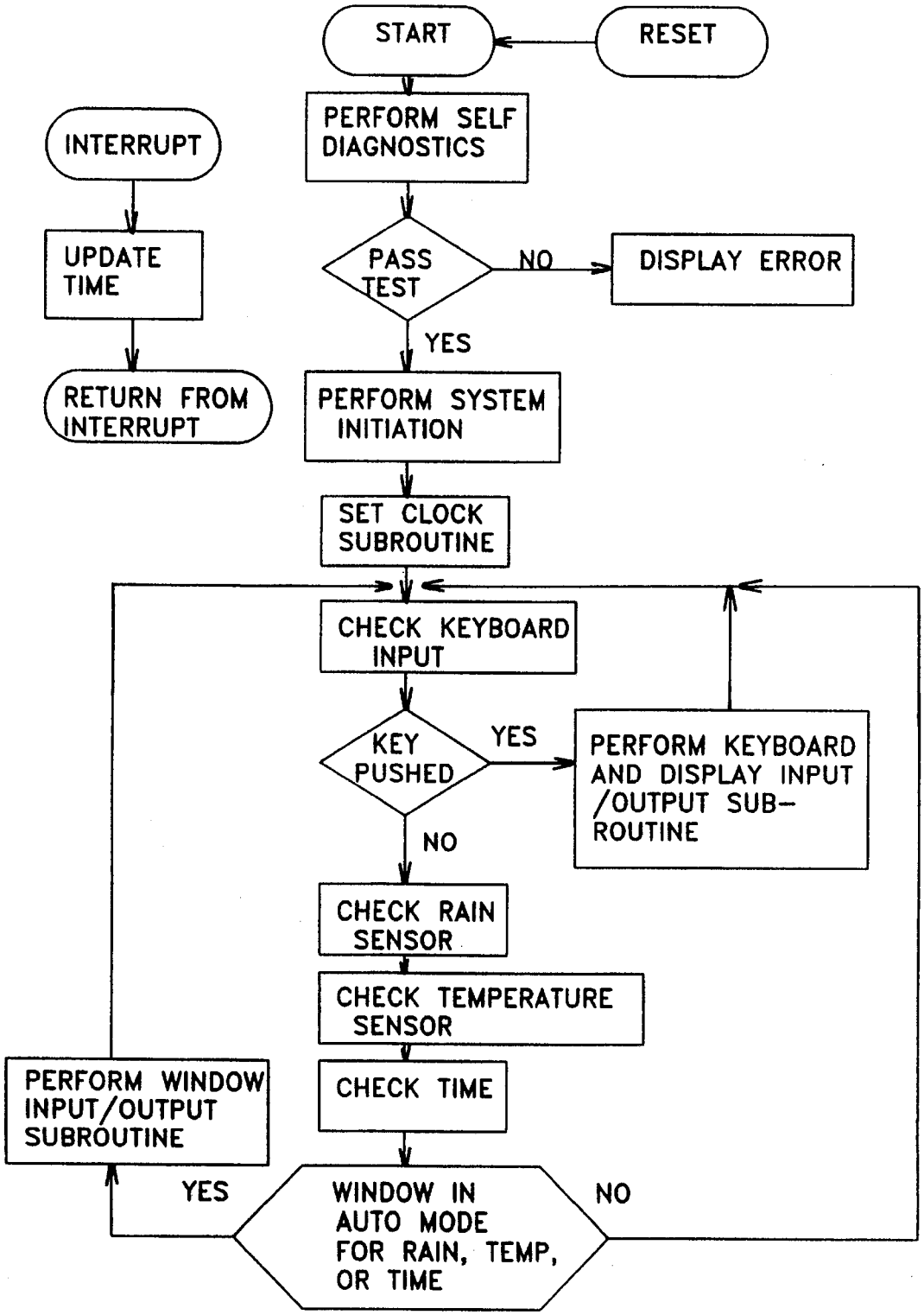
FIG. 7 is a system flow chart that depicts operation of the present invention.

Also provided is microprocessor-based controller circuitry 120. The controller circuitry is coupled to the power supply 70, the temperature sensor 80, the rain sensor 90, the real time clock 100, and the keyboard 110 as shown in FIG. 6. The controller circuitry is contained in a housing 122 as shown in FIG. 1. The controller circuitry is used for selectively generating a first motor activation signal and a second motor activation signal based upon receipt and evaluation of temperature indication signals, rain indication signals, real time clock signals, and instruction signals. The controller circuitry 120 controls operation of the system. The system state transition diagram is shown in FIG. 7. The controller circuitry can be coupled to a plurality of windows for controlling their operation. The controller circuitry contains a commercially available microprocessor 124 synchronized by an on-board clock 126. Random access memory (RAM) circuitry 128 and electrically programmable read only memory (EPROM) circuitry 130 are provided. The RAM circuitry is used for storing intermediate and transient results during operation while the EPROM circuitry is used for storing static system constants for operation such as selected dates, times, temperatures, precipitation levels, or the like. The controller circuitry also includes several dual in-line programmable (DIP) switches 132. These DIP switches are used for indicating to the microprocessor 124 how many windows are coupled to the system. The DIP switches may also be used for setting other configuration parameters. The controller circuitry also includes several tri-state buffers 134 for temporarily storing data input to the controller circuitry. The controller circuitry also includes several programmable interface adapters 142 for receiving instructions and data from various ancillary devices. The aforementioned components of the controller circuitry are tied together with a common address bus 136, a common data bus 138, and a common control bus 140. The controller circuitry may be programmed for automatically closing or opening a window based on selected times, dates, detected temperatures, detected precipitation levels, or the like. Resident software or firmware is included for allowing programmable functions to be realized.

Also provided with the present invention is a display mechanism 150 as shown in FIG. 1. The display mechanism is coupled to the controller circuitry 120 for providing a visual indication of operation. The display mechanism is conventional in design and can consist of a standard cathode ray tube or liquid crystal display circuitry. The display is interfaced through one of the programmable interface adapters 142 as shown in FIG. 6.

Figure 5:
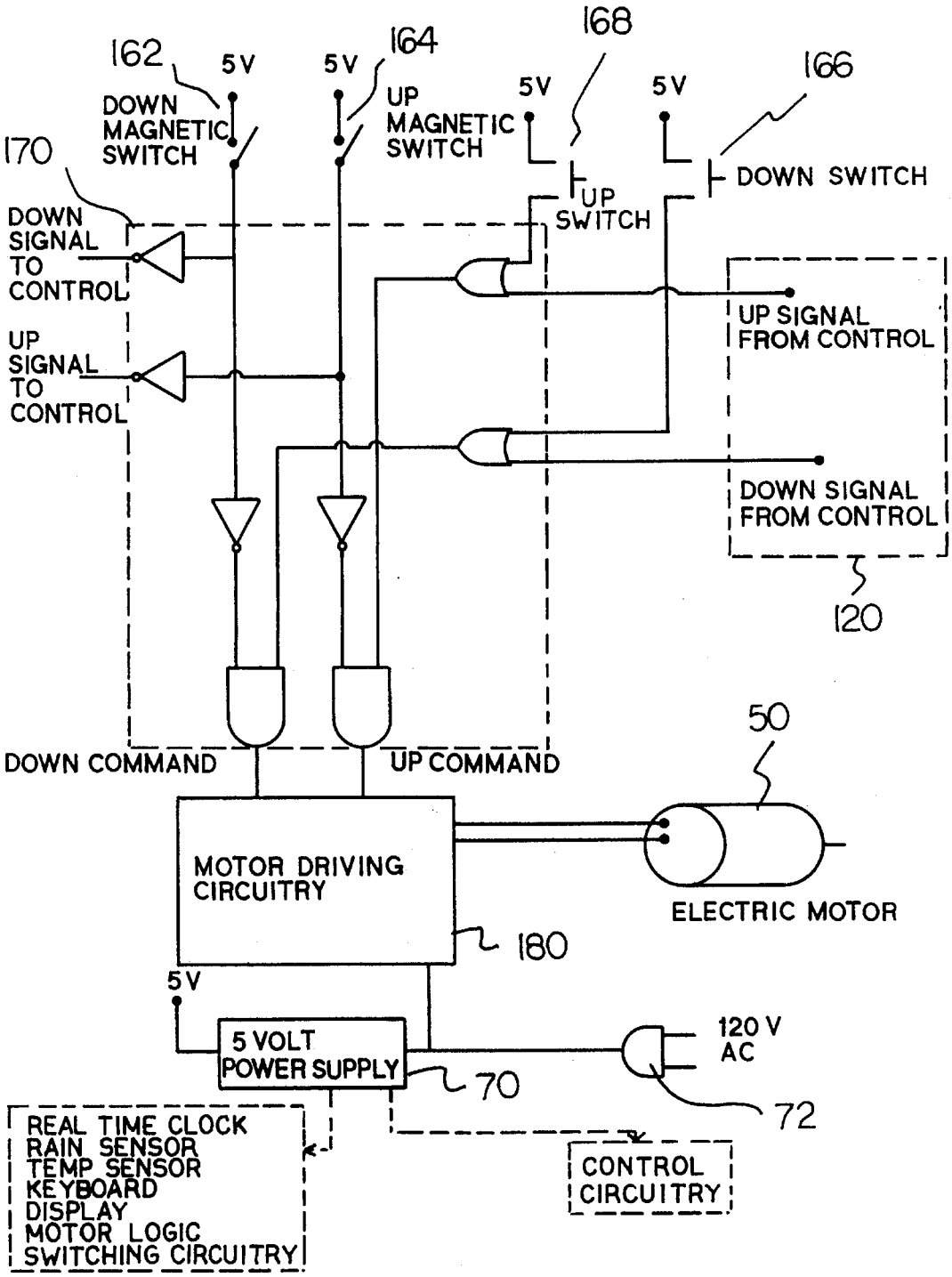
FIG. 5 is a schematic diagram of the motor switching circuitry of the present invention.

Also included with the present invention is motor logic circuitry 160 as best illustrated in FIG. 5. The motor logic circuitry is coupled to the power supply and frame 12 of the window as shown in FIG. 2. The motor logic circuitry controls operation of the motor. The motor logic circuitry includes a down magnetic switch 162 coupled to the frame 12 at a lower extent thereof. The down magnetic switch is engagable with one of the downwardly moving ball screw nuts 40 to thereby transmit a motor de-activation signal. Also included is an up magnetic switch 164. The up magnetic switch is coupled to the frame 12 at a central extent thereof. The up magnetic switch is engagable with one of the upwardly moving ball screw nuts to thereby transmit a motor de-activation signal. The relative positioning of the down magnetic switch and up magnetic switch is best illustrated in FIG. 2.

Also provided as part of the motor logic switch circuitry 160 is a momentary manually-depressible down switch 166. The down switch has one orientation for transmitting a first motor activation signal. Also provided is a momentary manually-depressible up switch 168. The up switch has one orientation for transmitting a second motor activation signal. The manually depressible switches are both contained in a common junction box 169 as shown in FIG. 2 and connected to the frame through a conduit.

The motor logic switching circuitry also includes combinatorial switch circuitry 170. The combinatorial switch circuitry is coupled to the switches 162, 164, 166, 168 and controller circuitry 120 for receiving the motor de-activation signals, first motor activation signals, and second motor activation signals from both the switches and controller circuitry, depending on which is activated during operation. The combinatorial switch circuitry then selectively transmits the motor de-activation signal, the first motor activation signal, and the second motor activation signal. The combinatorial switch circuitry is formed of OR gates, inverters, and AND gates as shown in FIG. 5. These gates are conventional in design and commercially available.

Lastly, the motor logic switch circuitry includes motor driving circuitry 180. The motor driving circuitry is coupled to the combinatorial switch circuitry 170 and the motor 50 as shown in FIG. 5. The motor driving circuitry allows the motor to be energized with a positive polarity upon receipt of the first motor activation signal. Furthermore, it allows the motor to be energized with a negative polarity upon receipt of the second motor activation signal. Lastly, the motor driving circuitry prevents the motor from being energized upon receipt of the motor de-activation signal. Thus, upon selective actuation of the switches in a manual fashion or actuation through the controller circuitry, the window can be raised or lowered.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A programmable automatic window for allowing automatic opening and closing of a window based on environmental, timing, and user instructions comprising, in combination:

a hollow rigid rectangular frame with a central rectangular aperture disposed therethrough;

a generally rectangular window including an upper part formed of a transparent sheet of material bounded by a rigid border secured within an upper extent of the aperture of the frame and a lower part formed of a transparent sheet of material bounded by a sash slidably secured within a lower extent of the aperture and positionable in a facing relationship with the upper part;

a pair of elongated rigid threaded ball screws disposed within the frame on either side of the window and with each ball screw having a base end rotatably coupled to the frame at a lower extent thereof and an upper end with an angled gear formed thereon extended a distance above the window;

a pair of opposed and threaded ball screw nuts with each ball screw nut threadedly disposed on one of the ball screws and with each ball screw nut fixedly coupled to the sash of the window;

a motor disposed within and coupled to the frame at a location above the window, the motor having a central fixed stator and an elongated rotatable rotor extended therethrough and with each end of the rotor having an angle gear coupled thereto in mesh with one of the angle gears of a ball screw, the motor electrically energizable with a positive polarity to cause rotation of the ball screws and upper displacement of the ball screw nut engaged therewith, thus allowing the lower part of the window to be raised for creating an opening for providing ventilation, the motor electrically engaged with a negative polarity to cause opposite rotation of the ball screws and downward displacement of the ball screw nut threadedly engaged therewith, thus allowing the lower part of the window to be lowered for closing the opening and preventing ventilation;

a hand crank mechanism coupled to the rotor of the motor and extended through the frame and actuatable by a hand-held wrench for manually rotating the rotor for generating movement of the lower part of the window;

a power supply coupleable with an external power source for providing electrical energy for operation;

a temperature sensor coupled to the frame and power supply for transmitting temperature indication signals;

a rain sensor coupled to the frame and power supply for transmitting rain indication signals;

a real time clock coupled to the power supply for transmitting real time clock signals;

a keyboard coupled to the power supply for generating a plurality of instruction signals upon actuation by a user;

microprocessor-based controller circuitry coupled to the power supply, the temperature sensor, the rain sensor, the real time clock, and the keyboard for selectively generating a first motor activation signal and a second motor activation signal based upon receipt and evaluation of temperature indication signals, rain indication signals, real time clock signals, and instruction signals;

a display mechanism coupled to the controller circuitry for providing a visual indication of operation; and motor logic switch circuitry coupled to the power supply for controlling operation of the motor and with the motor logic switch circuitry further comprising:

a down magnetic switch coupled to the frame at a lower extent thereof and engagable with one of the downwardly moving ball screw nuts to thereby transmit a motor de-activation signal;

an up magnetic switch coupled to the frame at a central extent thereof and engagable with one of the upwardly moving ball screw nuts to thereby transmit a motor de-activation signal;

a momentary manually-depressible down switch having one orientation for transmitting a first motor activation signal;

a momentary manually-depressible up switch having one orientation for transmitting a second motor activation signal;

combinatorial switch circuitry coupled to the switches and controller circuitry for receiving the motor de-activation signals, first motor activation signals, and second motor activation signals from both the switches and controller circuitry during operation and then selectively transmitting the motor de-activation signal, the first motor activation signal, and the second motor activation signal; and motor driving circuitry coupled to the combinatorial switch circuitry and the motor for allowing the motor to be energized with a positive polarity upon receipt of the first motor activation signal and for allowing the motor to be energized with a negative polarity upon receipt of the second motor activation signal and for preventing the motor from being energized upon receipt of the motor de-activation signal.

2. A programmable automatic window comprising:

a hollow frame with an aperture disposed therethrough;

an openable window secured within the aperture of the frame the window including an upper part formed of a transparent sheet of material bounded by a rigid border secured within an upper extent of the aperture of the frame and a lower part formed of a transparent sheet of material bounded by a sash slidably secured within a lower extent of the aperture and positionable in a facing relationship with the upper part;

a ball screw window control mechanism disposed within the frame and coupled to the window, the ball screw window control mechanism including a pair of elongated rigid threaded ball screws disposed within the frame on either side of the window and with each ball screw having a base end rotatably coupled to the frame at a first end thereof;

a pair of opposed and threaded ball screw nuts with each ball screw nut threadedly disposed on one of the ball screws and with each ball nut fixedly coupled to the sash of the window via a pin extending through the frame;

a motor coupled to the ball screw window control mechanism and electrically energizable to cause rotation of the ball screws for allowing the window to be opened and further electrically energizable to cause opposite rotation of the ball screws for allowing the window to be closed;

motor logic switch circuitry coupled to the motor and engagable with the ball screw window control mechanism for controlling operation of the motor;

a real time clock for transmitting real time clock signals;

a keyboard for generating a plurality of instruction signals upon actuation by a user; and microprocessor-based controller circuitry coupled to the real time clock, the keyboard, and the motor for selectively activating the motor based upon receipt and evaluation of the real time clock signals and instruction signals.

* * * * *